US007830222B2

(12) United States Patent
Kitamori et al.

(10) Patent No.: US 7,830,222 B2
(45) Date of Patent: Nov. 9, 2010

(54) NON-RECIPROCAL CIRCUIT DEVICE

(75) Inventors: Nobumasa Kitamori, Nagaokakyo (JP); Takashi Hasegawa, Omihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/700,814

(22) Filed: Feb. 5, 2010

(65) Prior Publication Data

US 2010/0127794 A1 May 27, 2010

Related U.S. Application Data

(63) Continuation of application No. PCT/JP2008/064130, filed on Aug. 6, 2008.

(30) Foreign Application Priority Data

Sep. 3, 2007 (JP) ..... 2007-227876

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS

| | | | | |
|---|---|---|---|---|
| 6,614,324 | B2 * | 9/2003 | Ohira et al. | 333/1.1 |
| 2002/0079981 | A1 | 6/2002 | Tanaka | |
| 2003/0006855 | A1 | 1/2003 | Yoneda | |
| 2007/0236304 | A1 | 10/2007 | Kawanami | |

FOREIGN PATENT DOCUMENTS

| | | | |
|---|---|---|---|
| JP | 2003-23305 | A | 1/2003 |
| JP | 2002-76711 | A | 3/2003 |
| JP | 2006-311455 | A | 11/2006 |
| WO | 2007/046229 | A1 | 4/2007 |

OTHER PUBLICATIONS

Official Communication issued in International Patent Application No. PCT/JP2008/064130, mailed on Sep. 30, 2008.
Wada et al.; "Nonreciprocal Circuit Device"; U.S. Appl. No. 12/700,806, filed Feb. 5, 2010.
Wada et al.; "Nonreciprocal Circuit Device"; U.S. Appl. No. 12/700,810, filed Feb. 5, 2010.
Official Communication issued in corresponding European Patent Application No. 08828967.3, mailed on Jul. 23, 2010.

* cited by examiner

*Primary Examiner*—Stephen E Jones
(74) *Attorney, Agent, or Firm*—Keating & Bennett, LLP

(57) ABSTRACT

A non-reciprocal circuit device capable of preventing and minimizing disturbances in magnetic field distribution in a ferrite to thereby improve insertion loss characteristics and isolation characteristics includes a ferrite to which a DC magnetic field is applied by permanent magnets and first and second center electrodes disposed on the ferrite. A conductive material is embedded in a recess provided in an end surface of the ferrite that is perpendicular or substantially perpendicular to the first and second principal surfaces of the ferrite, and the first and second center electrodes are electrically connected to the conductive material to define a circuit. Opening portions of the recess facing the first and second principal surfaces are arranged such that the opening portion at a downstream side of a direction of application of the DC magnetic field by the permanent magnets is larger than the opening portion at an upstream side thereof.

5 Claims, 7 Drawing Sheets

NON-RECIPROCAL CIRCUIT DEVICE

BACKGROUND OF THE INVENTION

1. Field of the Invention

The present invention relates to non-reciprocal circuit devices, and, more particularly, to non-reciprocal circuit devices, such as isolators or circulators, for use in the microwave band.

2. Description of the Related Art

In general, non-reciprocal circuit devices, such as isolators or circulators, have a characteristic of transmitting a signal only in a given direction but not in the opposite direction. By utilizing this characteristic, for example, isolators are used in transmitting circuits of mobile communication devices, such as automobile phones and cellular phones.

As a non-reciprocal circuit device of the type described above, a two-port isolator is known, in which, as described in International Publication No. 2007/046229, first and second center electrodes are provided on first and second principal surfaces, which face each other, of a ferrite, and the first and second center electrodes are electrically connected at the first and second principal surface sides, respectively, through a conductive material that has been embedded in a recess provided in the end surface of the ferrite. Moreover, a three-port isolator is known in which, as described in Japanese Unexamined Patent Application Publication No. 2002-076711, the conductive material that has been embedded in the recess provided in the end surface of the ferrite is electrically connected to the center electrodes.

In isolators, a DC magnetic field is applied to a ferrite from permanent magnets. Isolators have problems in that, when a recess is provided in a ferrite, and then a conductive material is embedded therein, a magnetic field distribution in the ferrite is disturbed depending on the shape of the recess. As a result, insertion loss characteristics and isolation characteristics are deteriorated.

SUMMARY OF THE INVENTION

Preferred embodiments of the present invention provide a non-reciprocal circuit device capable of reducing disturbances in magnetic field distribution in a ferrite and improving insertion loss characteristics and isolation characteristics by appropriately determining a shape of a recess provided in the ferrite so as to embed a conductor therein.

A non-reciprocal circuit device according to a preferred embodiment of the present invention includes permanent magnets, a ferrite to which a DC magnetic field is applied by the permanent magnets, and a plurality of center electrodes including conductor films that are disposed on first and second principal facing surfaces of the ferrite arranged to intersect each other while being electrically insulated, a conductive material being embedded in a recess provided in an end surface that is perpendicular or substantially perpendicular to the first and second principal surfaces of the ferrite, the center electrodes being electrically connected to the conductive material, and opening portions facing the first and second principal surfaces of the recess being arranged such that the opening portion at a downstream side of a direction of application of a DC magnetic field by the permanent magnets is larger than the opening portion at an upstream side thereof.

According to the present preferred embodiment of the present invention, by appropriately determining the shape of the recess provided in the ferrite so as to embed a conductive material therein, disturbances in magnetic field distribution in the ferrite are prevented and minimized to reduce insertion loss and increase isolation characteristics.

Other elements, features, steps, characteristics and advantages of the present invention will become more apparent from the following detailed description of the preferred embodiments with reference to the attached drawings.

BRIEF DESCRIPTION OF THE DRAWINGS

FIGS. 8A, 8B, and 8C are schematic views of the magnetic field distribution in the ferrite, in which FIG. 8A illustrates a first example, FIG. 8B illustrates a first comparative example, and FIG. 8C illustrates a second comparative example.

DETAILED DESCRIPTION OF THE PREFERRED EMBODIMENTS

Hereinafter, examples of a non-reciprocal circuit device according to preferred embodiments of the present invention will be described with reference to the attached drawings.

Figure 1:
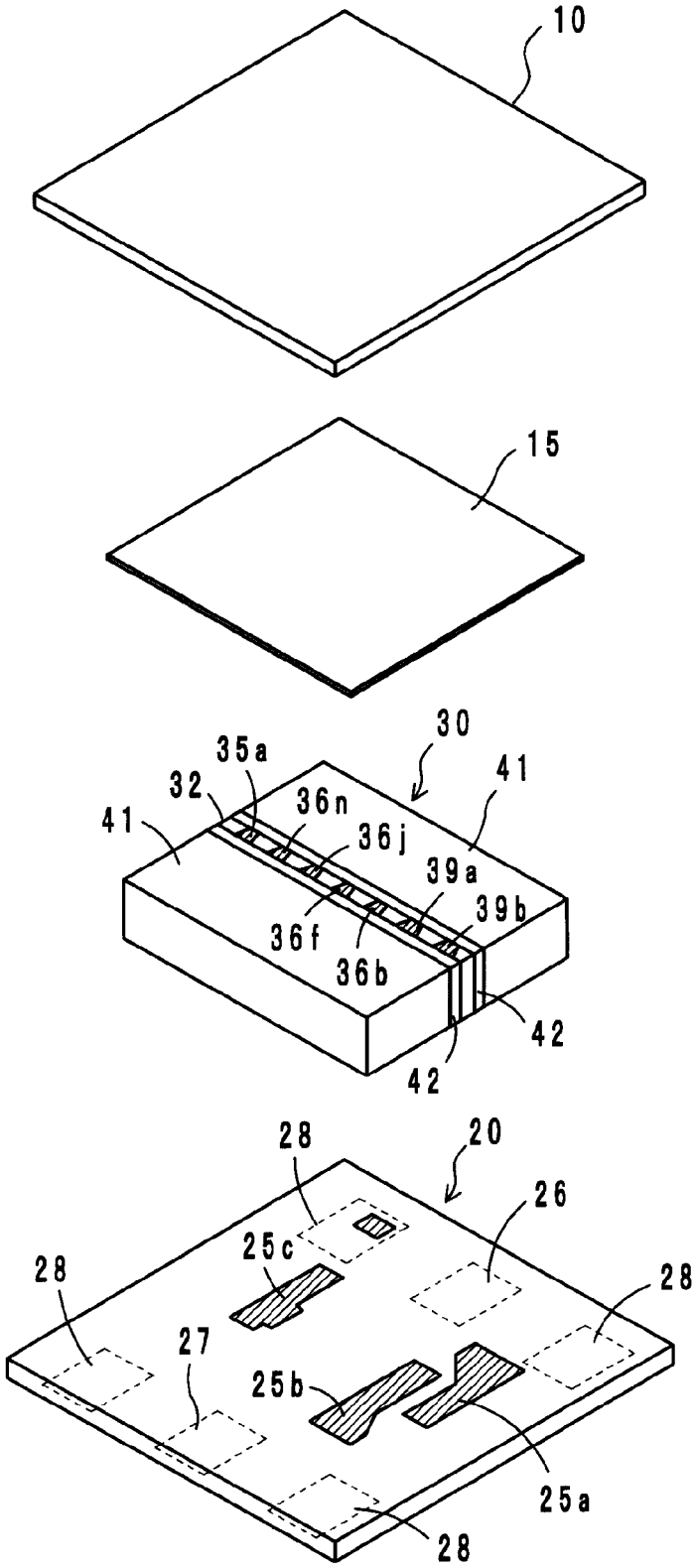
FIG. 1 is an exploded perspective view of a first example (two-port isolator) of a non-reciprocal circuit device according to a preferred embodiment of the present invention.

FIG. 1 illustrates an exploded perspective view of a two-port isolator as a first example of the non-reciprocal circuit device according to a preferred embodiment of the present invention. The two-port isolator preferably is a lumped constant type isolator, and preferably includes a planar yoke 10, a circuit board 20, a ferrite-magnet assembly including a ferrite 32 and permanent magnets 41. In FIG. 1, the diagonally shaded portion is a conductor.

Figure 2:
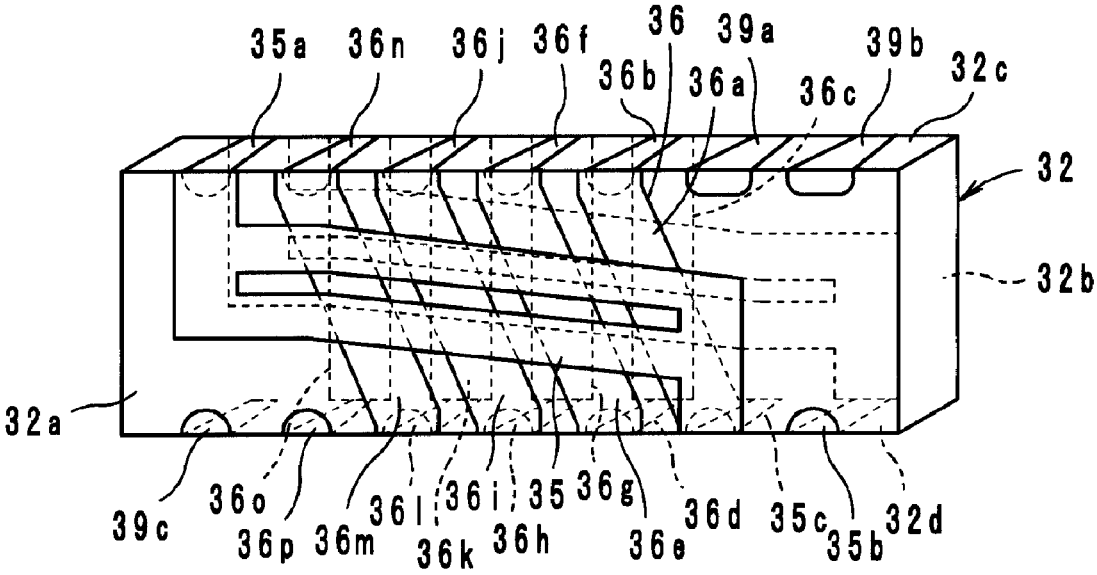
FIG. 2 is a perspective view of a ferrite including center electrodes.

As illustrated in FIG. 2, a ferrite 32 is provided with a first center electrode 35 and a second center electrode 36 that are electrically insulated from each other on first and second principal surfaces 32*a* and 32*b* of the front and rear surfaces. The ferrite 32 preferably has a rectangular parallelepiped shape, for example, including the first principal surface 32*a* and the second principal surface 32*b* that are facing each other and are in parallel or substantially in parallel to each other and includes end surfaces (upper surface 32*c* and lower surface 32*d*).

Figure 4:
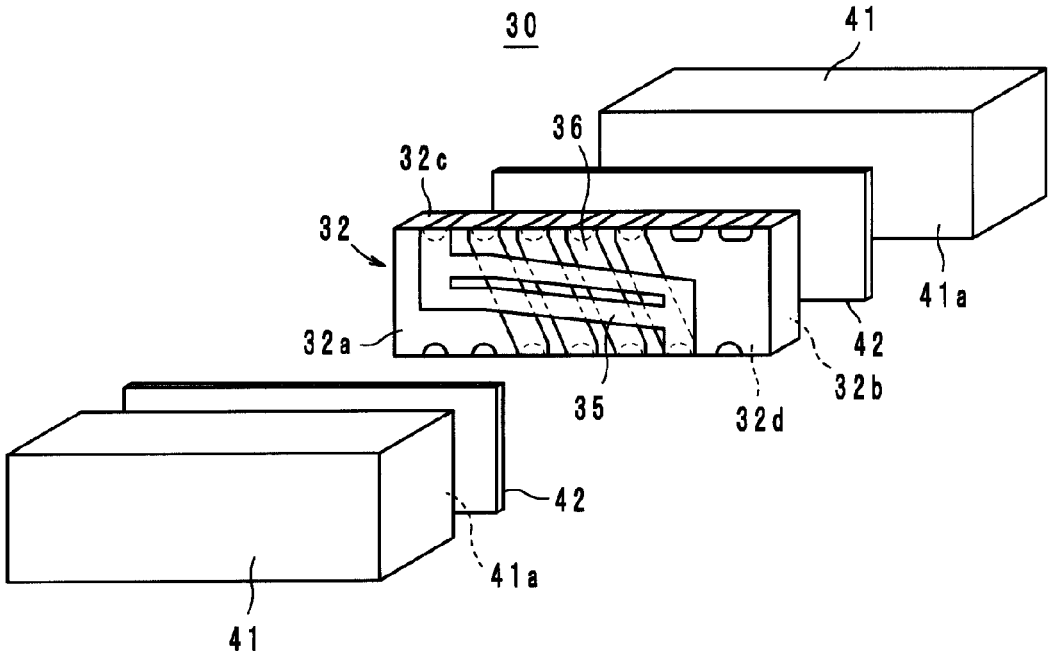
FIG. 4 is an exploded perspective view of a ferrite-magnet assembly.

The permanent magnets 41 are fixed to the ferrite 32 through, for example, an epoxy adhesive 42 (FIG. 4) so as to face the principal surfaces 32*a* and 32*b* so that a DC magnetic field is applied in a substantially perpendicular direction to the principal surfaces 32*a* and 32*b* to thereby define the ferrite-magnet assembly 30. A principal surface 41*a* of the permanent magnets 41 preferably have the same or substantially the same dimensions as the principal surfaces 32*a* and 32*b* of the ferrite 32. The principal surfaces 32*a* and 41*a* and the principal surfaces 32*b* and 41*a* are arranged to face each other so that the outer shapes line up with each other.

The first center electrode 35 preferably includes a conductive film. More specifically, as illustrated in FIG. 2, the first center electrode 35 extends upward from a lower right section of the first principal surface 32*a* of the ferrite 32 and bifurcates into two segments. The two segments extend in an upward left direction at a relatively small angle with respect to the longitudinal direction. The first center electrode 35 then extends upward to an upper left section and turns toward the second principal surface 32*b* through an intermediate electrode 35*a* on an upper surface 32*c*. On the second principal surface 32*b*, the first center electrode 35 bifurcates into two segments so as to overlap with that in the perspective view. One end of the first center electrode 35 is connected to a connector electrode 35*b* provided on the lower surface 32*d*. The other end of the first center electrode 35 is connected to a connector electrode 35*c* provided on the lower surface 32*d*. The first center electrode 35 is thus wound around the ferrite 32 by one turn. The first center electrode 35 and the second center electrode 36, which will be described below, have an insulating film provided therebetween, such that these electrodes intersect each other while being insulated from each other.

The second center electrode 36 also includes a conductive film. The second center electrode 36 includes a half-turn segment 36*a* that extends in the upward left direction from a lower right section of the first principal surface 32*a* at a relatively large angle with respect to the longitudinal direction and intersects the first center electrode 35. The half-turn segment 36*a* turns towards the second principal surface 32*b* through an intermediate electrode 36*b* on the upper surface 32*c*. On the second principal surface 32*b*, a 1st-turn segment 36*c* intersects the first center electrode 35 in a substantially perpendicular manner. A lower end portion of the 1st-turn segment 36*c* turns towards the first principal surface 32*a* through an intermediate electrode 36*d* on the lower surface 32*d*. On the first principal surface 32*a*, a 1.5-turn segment 36*e* extends substantially parallel to the half-turn segment 36*a* and intersects the first center electrode 35 on the first principal surface 32*a*. The 1.5-turn segment 36*e* turns toward the second principal surface 32*b* through an intermediate electrode 36*f* on the upper surface 32*c*. In a similar manner, a 2nd-turn segment 36*g*, an intermediate electrode 36*h*, a 2.5th-turn segment 36*i*, an intermediate electrode 36*j*, a 3rd-turn segment 36*k*, an intermediate electrode 36*l*, a 3.5th-turn segment 36*m*, an intermediate electrode 36*n*, and a 4th-turn segment 36*o* are provided on the corresponding surfaces of the ferrite 32. Both ends of the second center electrode 36 are respectively connected to connector electrodes 35*c* and 36*p* provided on the lower surface 32*d* of the ferrite 32. The connector electrode 35*c* is commonly used as a connector electrode for the ends of the first center electrode 35 and the second center electrode 36.

More specifically, the second center electrode 36 is helically wound around the ferrite 32 by four turns, for example.

Here, the number of turns is calculated on the basis of the fact that one crossing of the center electrode 36 across the first principal surface 32*a* or the second principal surface 32*b* equals a 0.5 turn. The intersection angle between the center electrodes 35 and 36 is set as required so as to adjust the input impedance and the insertion loss.

Figure 3:
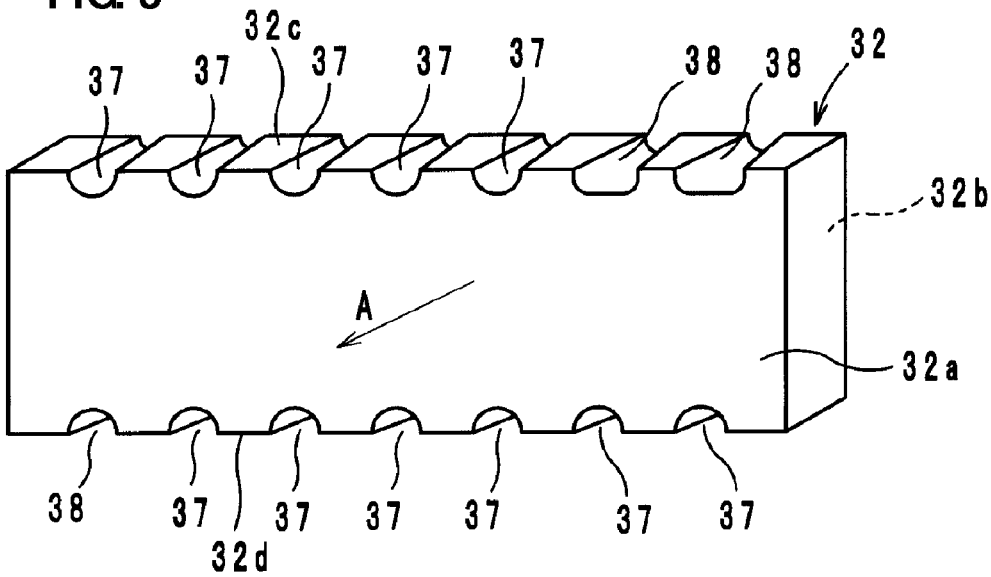
FIG. 3 is a perspective view of the ferrite.

The connector electrodes 35*b*, 35*c*, and 36*p* and the intermediate electrodes 35*a*, 36*b*, 36*d*, 36*f*, 36*h*, 36*j*, 36*l*, and 36*n* are provided preferably by embedding electrode conductors, such as silver, silver alloy, copper, and copper alloy, for example, into corresponding recesses 37 (FIG. 3) provided in the upper and lower surfaces 32*c* and 32*d* of the ferrite 32.

In addition, the upper and lower surfaces 32*c* and 32*d* include dummy recesses 38 arranged in parallel or substantially in parallel to the electrodes, and are also provided with dummy electrodes 39*a*, 39*b*, and 39*c*. These electrodes are provided preferably by preliminarily providing through holes in a mother ferrite substrate, embedding electrode conductors into these through holes, and then cutting the substrate along where the through holes are to be cut.

The recesses 37 and 38 have a substantially semicircular shape in cross section or a substantially oval shape in cross section and their openings face the first and second principal surfaces 32*a* and 32*b*. The opening portion at the downstream side (the first principal surface 32*a* side) of an application direction A of DC magnetic field by the permanent magnets 41 and 41 is larger than the opening portion at the upstream side (the second principal surface 32*b* side). More specifically, the recesses 37 and 38 taper toward the opening portion at the downstream side (the first principal surface 32*a* side) from the opening portion at the upstream side (the second principal surface 32*b* side). The effects obtained by the recesses 37 and 38 having such a shape will be described later.

As the ferrite 32, a YIG ferrite or the like may be used, for example. The first and second center electrodes 35 and 36 and the other various electrodes are preferably provided as a thick film or a thin film composed of silver or a silver alloy by, for example, printing, transferring, or photolithography, for example.

The insulating film between the center electrodes 35 and 36 may be formed of a thick glass or alumina dielectric film or polyimide resin film, for example. These insulating films can also be provided by, for example, printing, transferring, or photolithography.

The ferrite 32 including the insulating film and various electrodes can be collectively baked using a magnetic material. In such a case, Pd or Pd/Ag, which are tolerant of baking at high temperatures, is preferably used as the various electrodes.

For the permanent magnets 41, strontium, barium, or lanthanum-cobalt ferrite magnets are preferably used, for example. A one-part thermosetting epoxy adhesive is preferably used as the adhesive 42 that adheres the permanent magnets 41 and the ferrite 32, for example.

The circuit board 20 preferably is a sintered multilayer substrate including electrodes provided on a plurality of dielectric sheets. The circuit board 20 includes matching capacitors C1, C2, Cs1, Cs2, Cp1, and Cp2 illustrated in the equivalent circuits of FIGS. 5 and 6. The terminal resistance R is externally mounted on the circuit board 20. The circuit board 20 also includes terminal electrodes 25*a*, 25*b*, and 25*c* on the upper surface thereof and external-connection terminal electrodes 26, 27, and 28 on the lower surface thereof.

Figure 5:
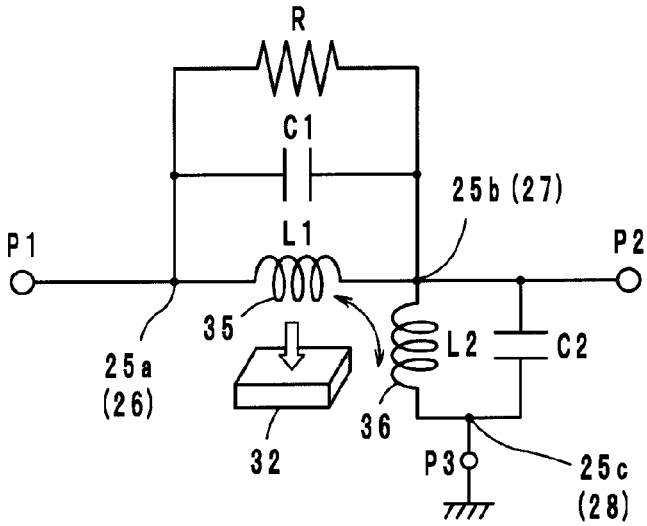
FIG. 5 is an equivalent circuit diagram of a first circuit example of a two-port isolator.
Figure 6:
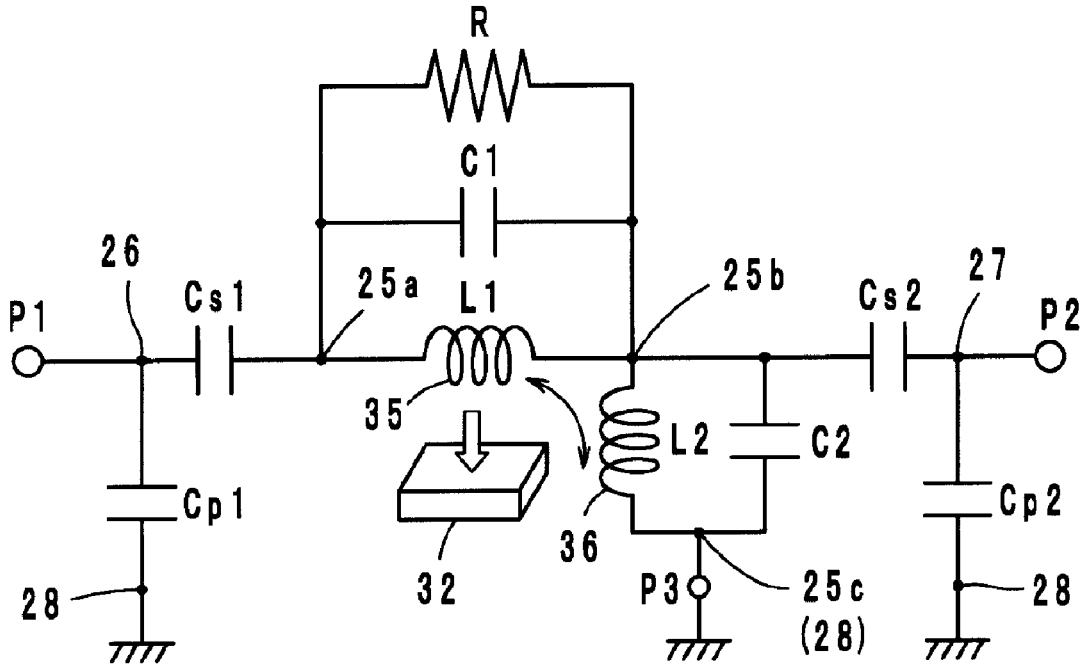
FIG. 6 is an equivalent circuit diagram of a second circuit example of a two-port isolator.

The connection relationships between these matching circuit elements and the first and second center electrodes 35 and 36 are as illustrated in FIG. 5 illustrating a first circuit example and FIG. 6 illustrating a second circuit example. Here, the connection relationships will be described on the basis of the first circuit example illustrated in FIG. 5.

The external-connection terminal electrode 26 provided on the lower surface of the circuit board 20 functions as an input port P1, and is connected to the matching capacitor C1 and the terminal resistor R. The terminal electrode 26 is connected to one end of the first center electrode 35 through the terminal electrode 25*a* provided on the upper surface of the circuit board 20 and the connector electrode 35*b* provided on the lower surface 32*d* of the ferrite 32.

The other end of the first center electrode 35 and one end of the second center electrode 36 are connected to the terminal resistor R and the matching capacitors C1 and C2 through the connector electrode 35*c* provided on the lower surface 32*d* of the ferrite 32 and the terminal electrode 25*b* provided on the upper surface of the circuit board 20, and are also connected to the external-connection terminal electrode 27 provided on the lower surface of the circuit board 20. The terminal electrode 27 functions as an output port P2.

The other end of the second center electrode 36 is connected to the capacitor C2 and the external-connection terminal electrode 28 provided on the lower surface of the circuit board 20 through the connector electrode 36*p* provided on the lower surface 32*d* of the ferrite 32 and the terminal electrode 25*c* provided on the upper surface of the circuit board 20. The electrode 28 functions as a ground port P3.

In the second circuit example illustrated in FIG. 6, the capacitors Cs1 and Cp1 are connected to the input port P1 side and the capacitors Cs2 and Cp2 are connected to the output port P2 side. These capacitors are used for impedance adjustment.

The ferrite-magnet assembly 30 is mounted on the circuit board 20. Various electrodes at the lower surface 32*d* of the ferrite 32 are unified with the terminal electrodes 25*a*, 25*b*, and 25*c* on the circuit board 20 by reflow soldering or other suitable process, for example, and the lower surfaces of the permanent magnets 41 are fixed to the circuit board 20 via an adhesive, for example.

The planar yoke 10 has an electromagnetic shielding function. The yoke 10 is fixed to the upper surface of the ferrite-magnet assembly 30 through the dielectric layer (adhesive layer) 15. The planar yoke 10 has functions of suppressing magnetic leakage and high-frequency electromagnetic field leakage from the ferrite-magnet assembly 30, of suppressing magnetic influences from the external environment, and of defining a portion to be taken up by a vacuum nozzle when this isolator is mounted on a substrate (not shown) using a chip mounter. The planar yoke 10 does not have to be grounded and may be grounded by soldering or a conductive adhesive. When grounded, the yoke 10 improves the effect of high-frequency shielding.

In the two-port isolator having the structure described above, since one end of the first center electrode 35 is connected to the input port P1, the other end of the first center electrode 35 is connected to the output port P2, one end of the second center electrode 36 is connected to the output port P2, and the other end of the second center electrode 36 is connected to the ground port P3, a two-port lumped-parameter isolator having a small insertion loss can be obtained. In addition, during operation of the isolator, a large amount of high-frequency current is supplied to the second center electrode 36 whereas a negligible amount of high frequency current is supplied to the first center electrode 35. Therefore, a direction of a high-frequency field generated using the first center electrode 35 and the second center electrode 36 depends on an arrangement of the second center electrode 36. Measures to reduce the insertion loss are readily performed when the direction of the high-frequency field is determined.

In the first example, as illustrated in FIG. 2, the recesses 37 and 38 provided in the upper and lower surface 32*c* and 32*d* of the ferrite 32 are arranged such that the opening portion at the downstream side (the first principal surface 32*a* side) of an application direction A of DC magnetic field by the permanent magnets 41 and 41 is larger than the opening portion at the upstream side (the second principal surface 32*b* side). More specifically, the recesses 37 and 38 taper toward the opening portion at the downstream side (the first principal surface 32*a* side) from the opening portion at the upstream side (the second principal surface 32*b* side).

When such recesses 37 and 38 define the through holes in the matrix of the ferrite 32, the through holes are provided by blasting or laser beam processing, for example. With the blasting, the recesses 37 and 38 are obtained by spraying fine particles of minute particle diameters to the surface of the matrix through a mask to thereby form tapered through holes at non-masking portions, and cutting the through holes. With the laser beam processing, the recesses 37 and 38 are obtained by irradiating the surface of the matrix of the ferrite 32 with a laser to thereby form tapered through holes at given portions, and the through holes are then cut.

A conductive material is embedded in the recesses 37 and 38 and a DC magnetic field is applied to the opening portion having a large area from the opening portion having a small area by the permanent magnets 41 and 41. Thus, disturbances in magnetic field distribution in the ferrite 32 are significantly reduced. Here, a magnetic field distribution simulated by the present inventors using the model illustrated in FIG. 7 is illustrated in FIGS. 8A-8C.

Figure 7:
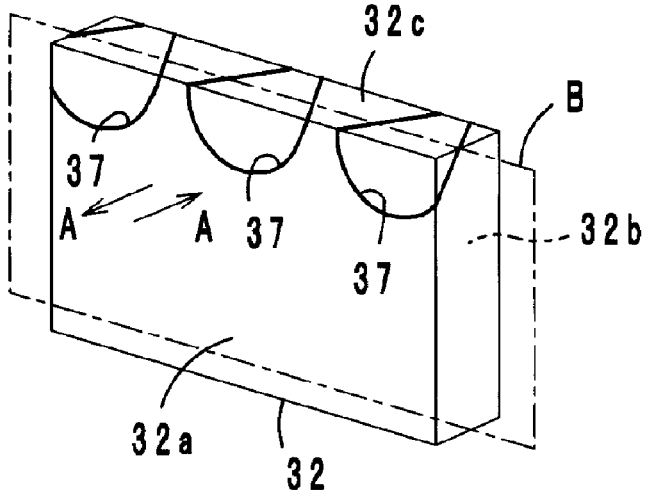
FIG. 7 is a view for illustrating a model for simulating a magnetic field distribution in a ferrite.

The model illustrated in FIG. 7 is structured so that, on the assumption that the recess 37 smoothly penetrates in a tapered manner toward the first principal surface 32*a* from the second principal surface 32*b* in the upper surface 32*c* of the ferrite 32, the opening portion at the first principal surface 32*a* side is large and the opening portion at the second principal surface 32*b* side is small, and then a conductive material is embedded therein, and that a magnetic field distribution at a plane B at the center of the tapered portion is observed.

Figure 8A:
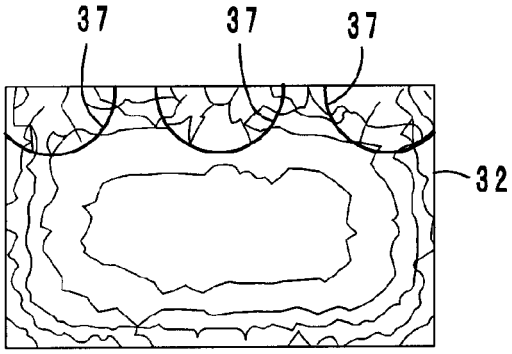
Figure 8B:
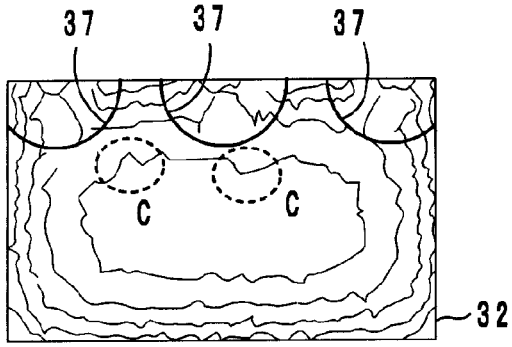
Figure 8C:
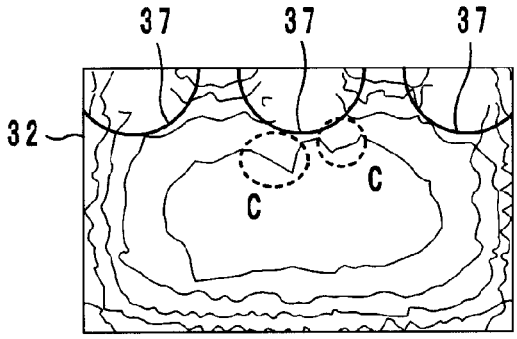

FIG. 8A illustrates simulation results of the magnetic field distribution at the plane B when the applying direction A of the DC magnetic field by the permanent magnets 41 and 41 is set to a direction from the small opening portion side to the large opening portion side (first example). FIG. 8B illustrates simulation results of the magnetic field distribution planar at the plane B when the applying direction A of DC magnetic field by the permanent magnets 41 and 41 is set to an opposite direction from the large opening portion side to the small opening portion side (first comparative example). FIG. 8C illustrates simulation results of the magnetic field distribution at the plane B when the recess 37 is formed in a straight shape having the same diameter as the opening portion of the first principal surface 32*a*, instead of the tapered shape (second comparative example). In the first and second comparative examples (FIGS. 8B and 8C), the magnetic field distribution is disturbed in a portion (portion near the recess 37) surrounded by the dotted line C. In contrast, such a disturbance in magnetic field does not arise in the first example (FIG. 8A).

Figure 9A:
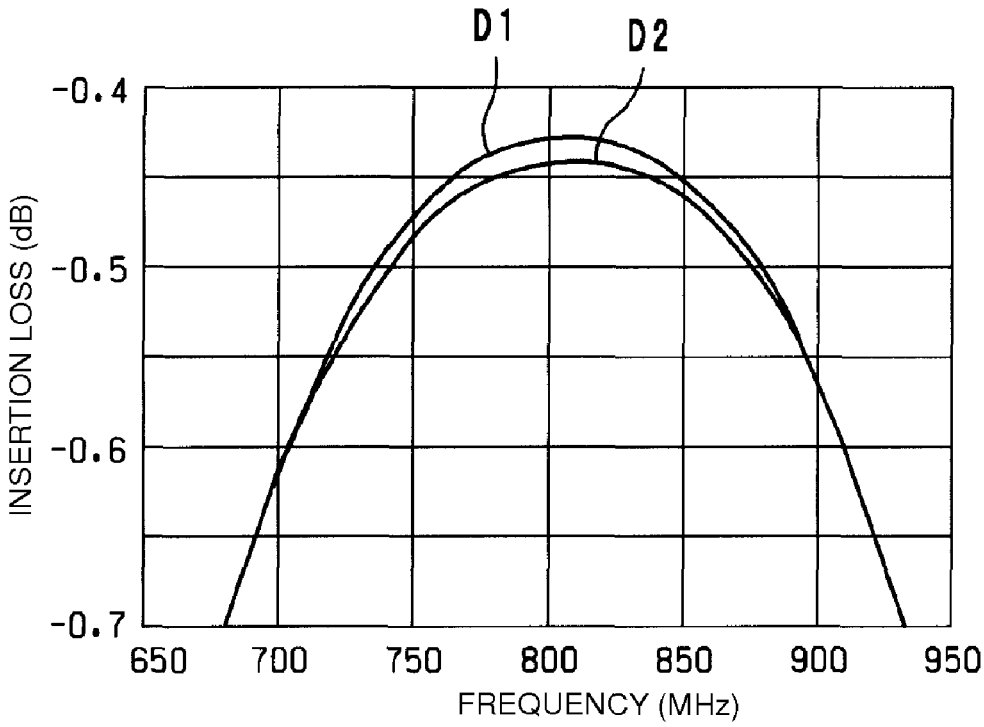
FIG. 9A is a graph illustrating insertion loss characteristics and FIG. 9B is a graph illustrating isolation characteristics.
Figure 9B:
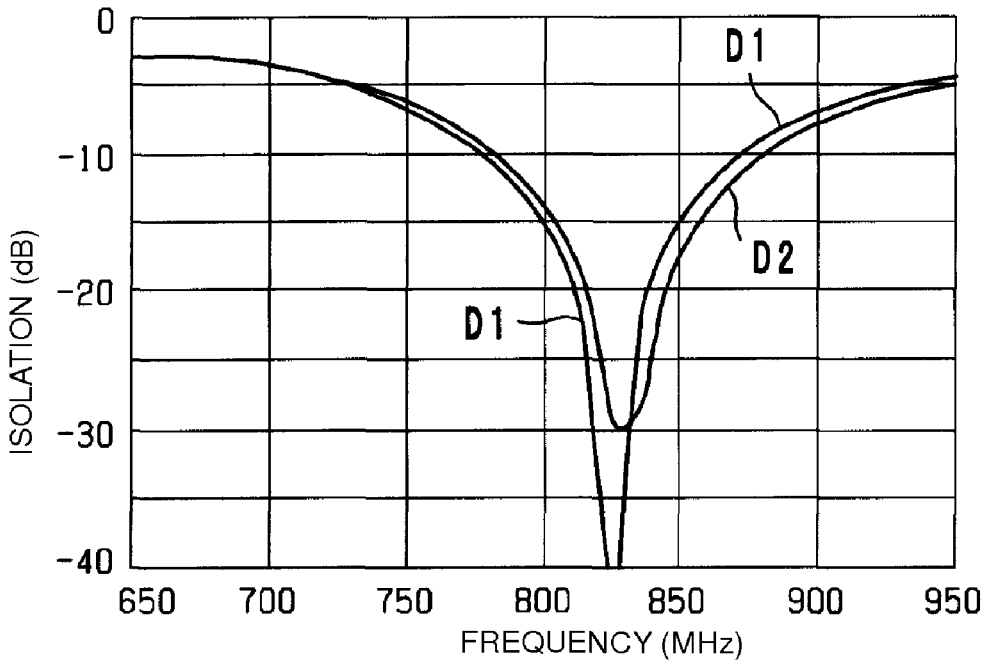

FIG. 9A illustrates insertion loss characteristics of the isolator and FIG. 9B illustrates isolation characteristics. In both FIGS. 9A and 9B, a curve D1 illustrates characteristics of the first example (FIG. 8A), and a curve D2 illustrates characteristics of the first comparative example (FIG. 8B). The characteristics of the second comparative example are almost in agreement with the curve D2. In the first example, the magnetic field is hardly disturbed compared with the first and second comparative examples, and thus the insertion loss and isolation in the 800 MHz band are improved. In particular, since the recesses 37 and 38 are smoothly tapered, disturbances in magnetic field distribution in the ferrite 32 are prevented and minimized, and very favorable properties are obtained.

In the first example, the ferrite-magnet assembly 30 is structurally stable because the ferrite 32 and a pair of permanent magnets 41 are joined via the adhesive 42, and thus serves as a strong isolator that is not deformed and damaged due to vibration or impact.

The circuit board 20 preferably includes a multi-layer dielectric substrate. Accordingly, a circuit network including capacitors and resistors can be included in the circuit board 20. Thus, a small and thin isolator can be achieved, and a significant increase in reliability can be achieved because circuit devices are connected to one another in the circuit board 20. The circuit board 20 is not necessarily a multilayer substrate, and may be a single-layer substrate, for example. Furthermore, matching capacitors or the like may be externally mounted as chip type capacitors.

Figure 10:
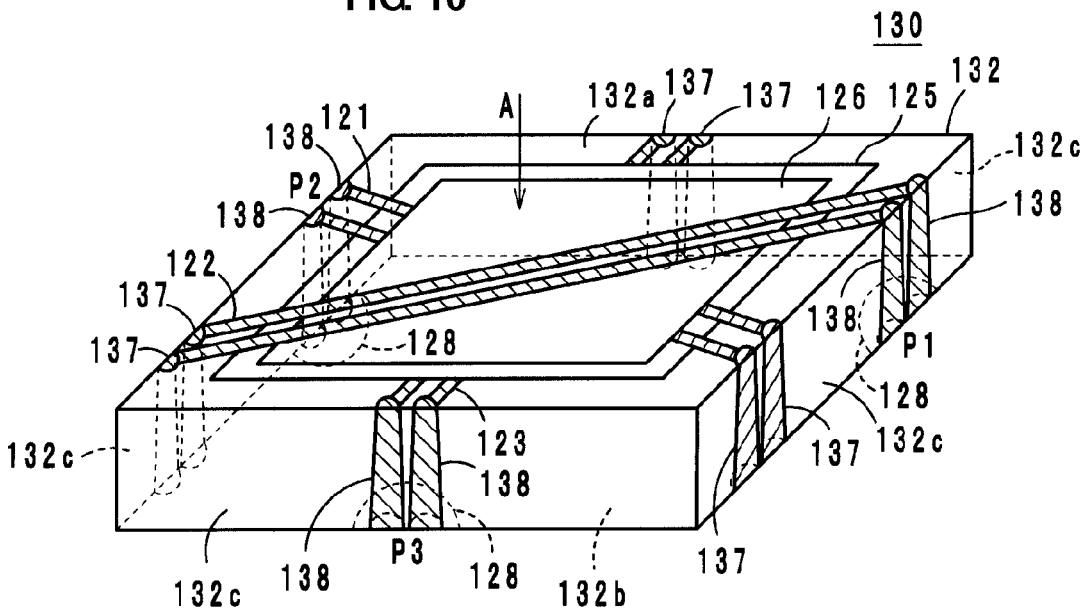
FIG. 10 is a perspective view of an essential portion of a second example (three-port isolator) of the non-reciprocal circuit device according to a preferred embodiment of the present invention.
Figure 11:
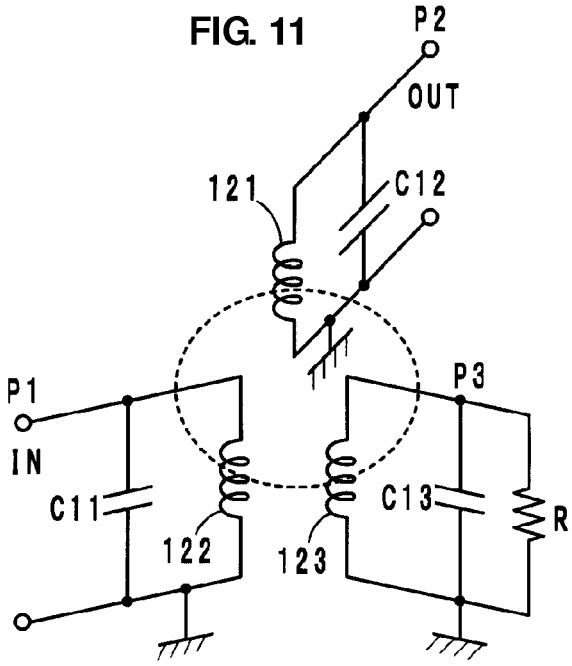
FIG. 11 is equivalent circuit diagram of a three-port isolator.

FIG. 10 illustrates an essential portion of a three-port isolator as a second example of the non-reciprocal circuit device according to a preferred embodiment of the present invention and FIG. 11 illustrates an equivalent circuit thereof. FIG. 10 illustrates a center electrode assembly 130 in which center electrodes 121, 122, and 123 each including two electrodes are provided using a conductor film on a first principal surface 132*a* of a ferrite 132 through insulating films 125 and 126.

To the center electrode assembly 130, a permanent magnet (not illustrated) is located at the first principal surface 132*a* side, and a DC magnetic field is applied in a direction substantially perpendicular to the first principal surface 132*a* (arrow A). On a second principal surface 132*b* of the ferrite 132, a ground pattern is arranged to extend substantially over the entire surface. Both ends of each of the center electrodes 121, 122, and 123 are extended to the second principal surface 132*b* by a connector electrode formed of a conductive material embedded in recesses 137 and 138 provided at four end surfaces 132*c* of the ferrite 132. One end of each of the center electrodes 121, 122, and 123 is electrically connected to the ground pattern through the electrodes embedded in the recesses 137 and the other end of each of the center electrodes 121, 122, and 123 faces the second principal surface 132*b* through the electrodes embedded in the recesses 138, but is electrically separated from the ground pattern by gaps 128.

Moreover, as illustrated in the equivalent circuit of FIG. 11, a matching capacitor C11 is inserted in parallel with the center electrode 122 between the port P1 and the ground pattern. A matching capacitor C12 is inserted in parallel with the center electrode 121 between the port P2 and the ground pattern. A matching capacitor C13 is inserted in parallel with the center electrode 121 between the port P3 and the ground pattern.

The structure of such a non-reciprocal circuit device is described in detail in Japanese Unexamined Patent Application Publication No. 2002-076711.

Similarly as in the first example, the recesses 137 and 138 open so as to face the first and second principal surfaces 132*a* and 132*b* of the ferrite 132. The opening portion at the downstream side (the second principal surface 132*b* side) of the application direction A of DC magnetic field by the permanent magnets is larger than the opening portion at the upstream side (the first principal surface 132*a* side). More specifically, the recesses 137 and 138 smoothly taper toward the opening portion at the downstream side (the second principal surface 132*b* side) from the opening portion at the upstream side (the first principal surface 132*a* side). Accordingly, as in the first example, disturbances in magnetic field distribution in the ferrite are prevented and minimized to thereby reduce insertion loss and increase isolation.

In the above-described non-reciprocal circuit device, in order to embed the conductive material for connection with the center electrodes, the recesses provided in the end surface that is perpendicular or substantially perpendicular to the first and second principal surfaces of the ferrite preferably have a shape in which the opening portion at the downstream side of the applying direction of DC magnetic field by the permanent magnets is larger than the opening portion at the upstream side thereof. Thus, disturbances in magnetic field distribution in the ferrite are prevented and minimized to thereby improve insertion loss characteristics and isolation characteristics.

In particular, by electrically connecting the first center electrode and the second center electrode with the conductive material embedded in the recess and winding them around the ferrite, a two-port lumped constant type isolator having small insertion loss can be obtained.

Preferably, the recess tapers toward the opening portion at the downstream side of the applying direction of DC magnetic field from the opening portion at the upstream side thereof. Thus, disturbances in magnetic field distribution in the ferrite are minimized.

The non-reciprocal circuit device according to the present invention is not limited to the preferred embodiments and examples above, and can be variously changed within the scope of the present invention.

For example, when the N pole and the S pole of the permanent magnets 41 are reversed, the input port P1 and the output port P2 are interchanged. The shapes of the first and second center electrodes 35 and 36 can be variously changed. For example, the first preferred embodiment describes that the first center electrode 35 is preferably bifurcated into two segments on the principal surfaces 32*a* and 32*b* of the ferrite 32, but it may not be bifurcated into two segments. The second center electrode 36 may be wound by at least one turn.

As described above, various preferred embodiments of the present invention are useful for a non-reciprocal circuit device, and are excellent particularly in that disturbances in magnetic field distribution in the ferrite are prevented and minimized to thereby improve insertion loss characteristics and isolation characteristics.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A non-reciprocal circuit device, comprising:

permanent magnets;

a ferrite arranged to receive a DC magnetic field applied by the permanent magnets;

a plurality of center electrodes including conductor films that are disposed on first and second principal surfaces of the ferrite that face each other so as to intersect each other while being electrically insulated from one another; and a conductive material embedded in a recess provided in an end surface of the ferrite that is perpendicular or substantially perpendicular to the first and second principal surfaces of the ferrite; wherein the center electrodes are electrically connected to the conductive material; and opening portions of the recess facing the first and second principal surfaces are arranged such that the opening portion at a downstream side of a direction of application of the DC magnetic field by the permanent magnets is larger than the opening portion at an upstream side thereof.

2. The non-reciprocal circuit device according to claim 1, wherein the plurality of center electrodes include first and second center electrodes, a first end of the first center electrode is electrically connected to an input port and a second end thereof is electrically connected to an output port;

a first end of the second center electrode is electrically connected to an output port and a second end thereof is electrically connected to a ground port;

a first matching capacitance is electrically connected between the input port and the output port;

a second matching capacitance is connected between the output port and the ground port; and a resistance is electrically connected between the input port and the output port.

3. The non-reciprocal circuit device according to claim 1, wherein the recess tapers toward the opening portion at the downstream side of the application direction of the DC magnetic field from the opening portion at the upstream side thereof.

4. The non-reciprocal circuit device according to claim 1, wherein the ferrite and the permanent magnets constitute a ferrite-magnet assembly in which the ferrite is sandwiched by a pair of the permanent magnets from both sides in parallel or substantially in parallel with the first and second principal surfaces on which the first and second center electrodes are disposed.

5. The non-reciprocal circuit device according to claim 4, further comprising a circuit board including a terminal electrode on a surface of the circuit board, the ferrite-magnet assembly being disposed on the circuit board such that the first and second principal surfaces are perpendicular or substantially perpendicular to the surface of the circuit board.

* * * * *